US005368307A

United States Patent [19]

Hotchkiss

[11] Patent Number: 5,368,307

[45] Date of Patent: Nov. 29, 1994

[54] PRACTICE TARGET FOR BOWFISHING

[76] Inventor: Kenneth J. Hotchkiss, 20 Clifton St., Phelps, N.Y. 14532

[21] Appl. No.: 66,305

[22] Filed: May 24, 1993

[51] Int. Cl.[5] ..... F41J 3/00

[52] U.S. Cl. ..... 273/350; 273/408

[58] Field of Search ..... 273/348, 350, 403, 404, 273/408; 446/153, 154, 155, 268

[56] References Cited

U.S. PATENT DOCUMENTS 2,320,145 5/1943 La Due ..... 273/350

3,095,197 6/1963 Weitzman ..... 273/350

4,643,434 2/1987 Carlin ..... 273/408

4,850,596 7/1989 Olund ..... 273/408

*Primary Examiner*—William H. Grieb

*Attorney, Agent, or Firm*—Hoffman Stone

[57] ABSTRACT

A practice target for the bowfisher made of a waterproof, relatively rigid, expanded, closed cell foamed plastic material such as polyethylene or polyurethane, colored to resemble a finny fish, and an anchor arrangement to hold the target submerged at a preselected depth below the surface of the water.

2 Claims, 1 Drawing Sheet

PRACTICE TARGET FOR BOWFISHING

This invention relates to a novel practice target for bowfishing, and more particularly, to a target that can be held submerged in water at a preselected depth to enable the archer to gain experience in judging the effects of refraction on under water target location, Fishing with bows and arrows is becoming increasingly popular among archers, but so far as is known no practical practice target has been offered to those participating in the sport.

BRIEF SUMMARY OF THE INVENTION

Briefly, the invention contemplates a practice bowfishing target made of a waterproof, relatively rigid, expanded, closed cell foamed plastic material such as, for example, polyethylene or polyurethane, Materials of this sort are especially well suited for use as archery targets because they exhibit a characteristic called "self-healing" and can absorb being pierced many, many times by target arrows without crumbling or losing their shape, and while still maintaining a high proportion of their original strength, The target is preferably cut from a block of the plastic foam and is decorated to resemble an actual fish. Fishline leader may be used to anchor the target, being passed vertically through the target body and secured below the target to an anchor. If desired a retrieval cord may be attached to the target or to the anchor line to facilitate locating and picking up the target after use.

DETAILED DESCRIPTION

Figures 1, 2:
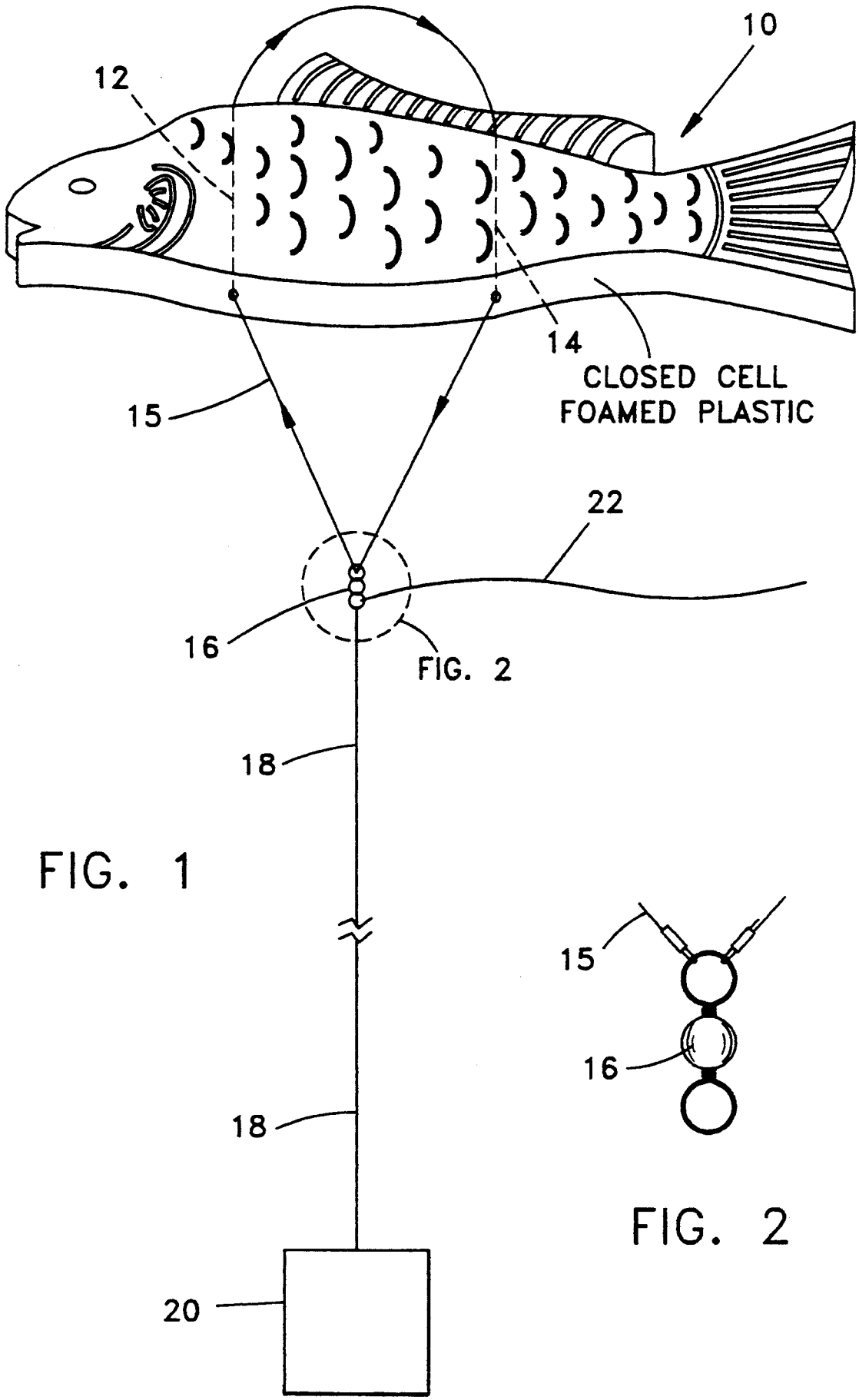

A presently preferred embodiment of the invention will now be described in detail in conjunction with the drawing, wherein:

FIG. 1 is a view of a target according to the invention as seen from a relatively low angle, looking generally upwards; and FIG. 2 is a partial view of the preferred rigging arrangement for anchoring the target, The target 10, as shown, consists of a shaped block of closed cell, expanded polyethylene foam cut in the outline of a fish and preferably painted or otherwise decorated to resemble a fish, at least from the side, Typically, the foam may be about two and one-half to three inches thick, and the target may be about twenty to twenty-four inches long, depending, of course on the kind of fish the archer intends to hunt.

The user is instructed to pierce the target body to make two holes 12 and 14 approximately along the mid-plane of the fish body extending from bottom to top. Fishline leader 15 is passed through the two holes, over the top (or back?) of the fish, and down to any selected point directly below the fish where it is secured through a swivel 16 to a line 18 leading to an anchor 20, The length of the anchor line 18 is adjusted by the user to hold the target at the depth desired by the user, It has been found that for a target about three inches thick and two feet long, shaped approximately as shown in FIG. 1, a dead weight of at least about twelve pounds at a density of at least about 2.0 is needed to hold the target submerged, and the anchor line is recommended to be one hundred pound test strength of Dacron or equivalent.

If desired, a retrieval line 22 may also be attached, either to the swivel 16 or to the fish body itself, and furnished with a small buoy (not shown) for facilitating locating and picking up the target at the end of the practice session.

The target is surpisingly long lasting and highly resistant to crumbling. After an arrow is pulled from it, the hole where the arrow penetrated heals within about an hour or so, leaving a noticeable scar but not appreciably weakening the target. It is this healing effect that gives the closed cell foamed plastic its self-healing designation. The target is also surprisingly strong and rigid.

What is claimed is:

1. An artificial practice target for bowfishing comprising a body shaped to resemble the shape of a fish, said body being formed of a rigid, closed cell, expanded plastic foam, and an arrangement for securing the body to an anchor to hold it submerged thereby to give the archer practice judging the effects of refraction on the apparent position of an under-water fish, 2. A practice target according to claim 1 in which the body is colored to simulate a finny fish.

* * * * *